United States Patent [19]

Summers et al.

[11] 4,317,492

[45] Mar. 2, 1982

[54] METHOD AND APPARATUS FOR DRILLING HORIZONTAL HOLES IN GEOLOGICAL STRUCTURES FROM A VERTICAL BORE

[75] Inventors: David A. Summers; Clark R. Barker; H. Dean Keith, all of Rolla, Mo.

[73] Assignee: The Curators of the University of Missouri, Columbia, Mo.

[21] Appl. No.: 124,946

[22] Filed: Feb. 26, 1980

[51] Int. Cl.[3] ..... E21B 4/00

[52] U.S. Cl. ..... 175/79; 175/61; 175/62; 175/94; 175/257; 175/320

[58] Field of Search ..... 175/61, 62, 73–80, 175/94, 98, 99, 257, 75, 320, 67

[56] References Cited

U.S. PATENT DOCUMENTS

| | | | |
|---|---|---|---|
| 1,660,999 | 2/1928 | Macdonell | 175/79 |
| 2,147,214 | 2/1939 | Perebaskine et al. | 175/78 |
| 2,251,308 | 8/1941 | Washington | 254/95 |
| 4,193,635 | 3/1980 | Thiruvengadam | 175/67 |

*Primary Examiner*—William F. Pate, III

*Attorney, Agent, or Firm*—Ray E. Snyder

[57] ABSTRACT

This invention is directed to a method and apparatus for drilling horizontal holes in geological strata from a vertical position. The geological structures intended to be penetrated in this fashion are coal seams, as for in situ gasification or methane drainage, or in oil-bearing strata for increasing the flow rate from a pre-existing well. Other possible uses for this device might be for use in the leaching of uranium ore from underground deposits or for introducing horizontal channels for water and steam injections.

7 Claims, 13 Drawing Figures

Fig. 7A.
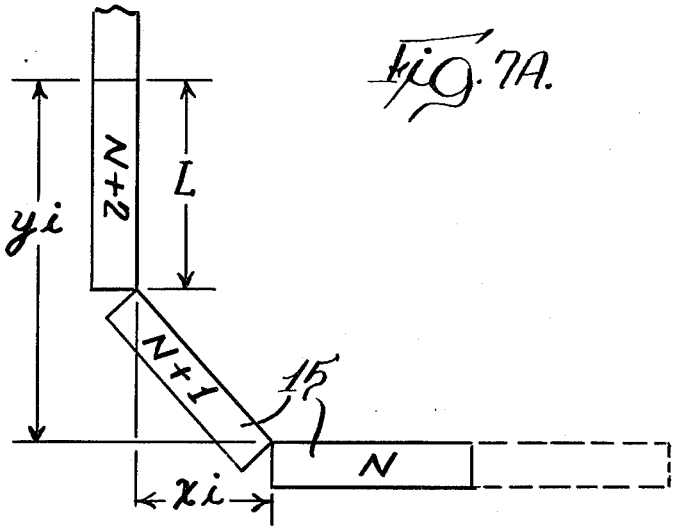
Fig. 7B.
Fig. 8.
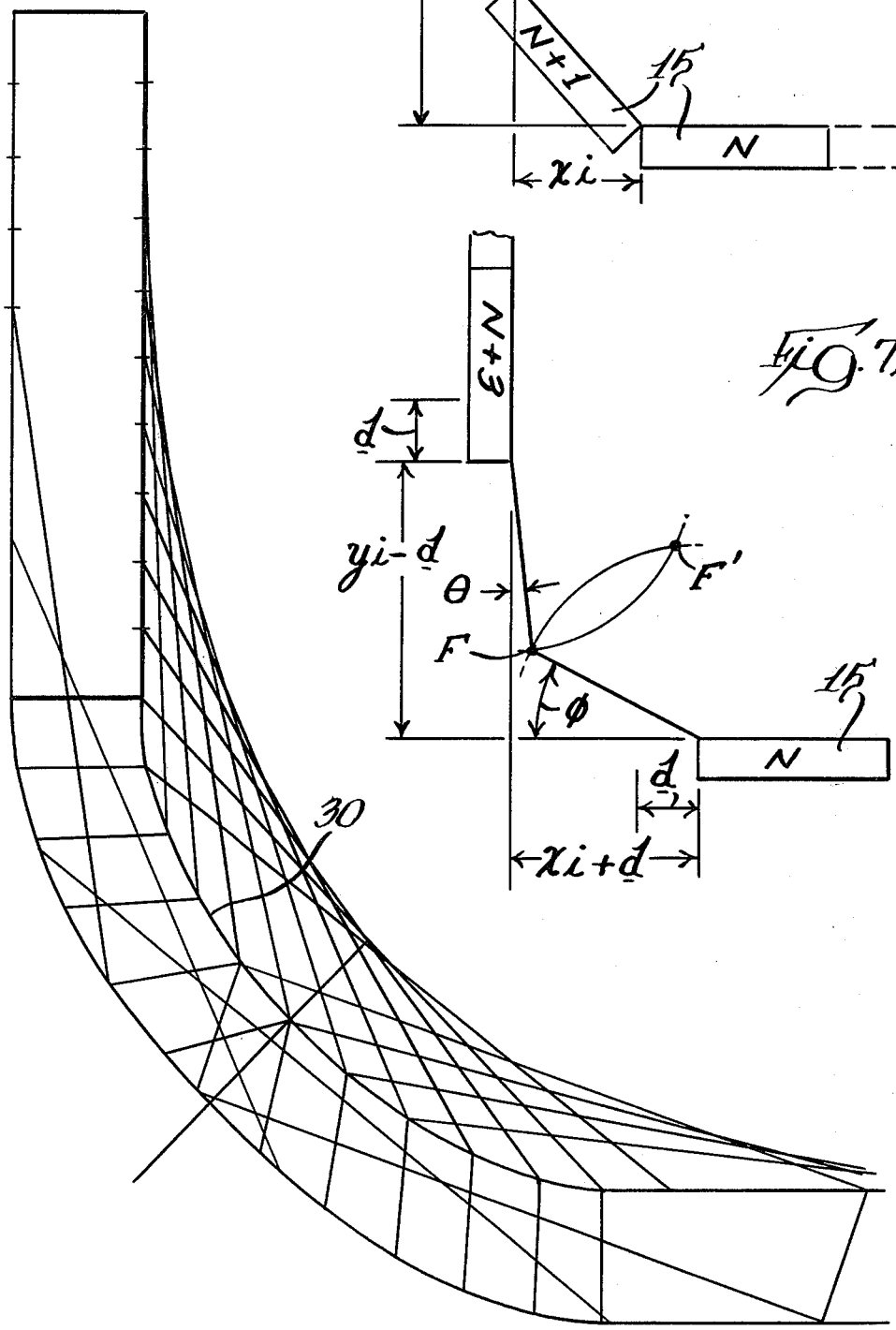

METHOD AND APPARATUS FOR DRILLING HORIZONTAL HOLES IN GEOLOGICAL STRUCTURES FROM A VERTICAL BORE

BACKGROUND OF THE INVENTION

1. Field of the Invention

The invention relates generally to the field of earth penetrating and boring particularly by using high pressure water jets.

2. Description of the Prior Art

Conventional drilling and mining techniques using mechanical equipment are well known in the art. High pressure water jets for fluid erosion in mining and drilling are also well known. Examples of such art are the patents to Summers, et al U.S. Pat. No. 4,119,160 and U.S. Pat. No. 4,106,577. The continuing and increasing demand for energy has dictated that new techniques be devised for increasing the available supplies of energy, and a conversion into convenient and distributable forms. Some of these techniques currently are directed to the in situ gasification of coal to produce a combustible gas as a replacement for natural gas. These techniques also include new means for extracting oil from existing wells where the oil is bound up in very viscous mixtures such as tar sand or oil shale.

One technique that has been used in the in situ gasification of coal has been the employment of vertical wells spaced approximately 100′ apart and linked by a horizontal hole in the coal seam. The horizontal link is accomplished by reverse combustion burning and directional drilling. In the case of reverse combustion, the fire is propagated from the base of one vertical well to the other by forcing air down one well while the fire is initiated at the other. The air flows to the flame front through the bedding planes and hopefully burns back toward the air supply. This method has been successful only about half of the times tried with the major reason for failure being that the fire overrides the coal seam.

Tests have also been made using directional drilling to achieve linkage between adjacent wells. These techniques are similar to directional drilling employed in drilling oil wells. Most generally the minimum radius for such drilling is about 100′. In addition, maintaining the alignment or elevation of the drills so as to stay within the coal seam is difficult to achieve. Moreover, when long distances are involved, the frictional forces become great and unless the thrust is controlled within a particular range, the drill bit can actually travel above or below the seam. The problems encountered in the directional drilling using conventional means are described in considerable detail in the paper entitled "Directional Controlled Drilling to Horizontally Intercept Selected Strata, Upper Freeport Coal Bed, Green County, Pa." by William P. Diamond, David C. Oyler and Herbert H. Fields. This report is published by the U.S. Department of the Interior, Report of Investigations No. 8231. In one test reported, it took 4½ months to drill a 200′ horizontal hole at a depth of 1000′.

SUMMARY OF THE INVENTION

This invention is directed to the drilling of horizontal holes, particularly in coal seams, from a vertical well bore and doing so within a turning radius of approximately 9–10″. It is an object to provide a method and apparatus for drilling a plurality of radial horizontal holes from a single vertical well bore for use in methane drainage or in the in situ gasification of coal. In doing so, it is contemplated that a flow pattern would be established between adjacent wells.

It is another object that the same technique be employed in oil wells for producing horizontal bores from a well and thereby establish a means for fluid injection for the production of oil at adjacent wells. Alternatively, the technique known as "huff-n-puff" can be employed for removing oil from the same well.

It is an additional object of the present invention to provide an improved drilling technique utilizing a drill stem having a high pressure water jet drilling nozzle and a plurality of interlinked, articulated boxes which are hinged together on one side so as to allow right angle turning motion within a very small radius. In addition, detent or interlocking means can also be employed between the individual boxes so as to maintain them in a linear array, once they have traversed the right angle corner for horizontal drilling.

BRIEF DESCRIPTION OF THE DRAWINGS

FIGS. 7A and 7B are schematic diagrams of the drill string as the individual boxes pass through the right angle transition; and FIG. 8 is a composite schematic diagram showing the successive positions of the boxes in the right angle transition.

DETAILED DESCRIPTION OF THE PREFERRED EMBODIMENT

Figure 1:
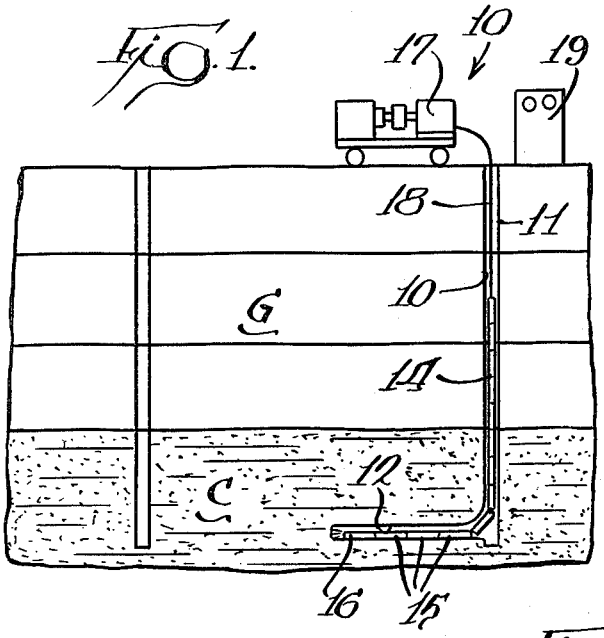
FIG. 1 is a schematic diagram of the overall drilling arrangement utilizing the right angle drilling system in a geological formation.

Referring to FIG. 1, there is shown a schematic illustration of the overall drilling system D disposed in a vertical well bore 10 which has been drilled in a geological formation G. A horizontal channel 12, at right angles to the well bore 10, is drilled in a formation designated herein as C. The formation C may be a coal seam, oil-bearing strata, or other geological formation. The system and apparatus D will be described herein as adapted for drilling horizontal holes in coal; however, it is to be understood that the apparatus and technique are equally adaptable for drilling horizontal holes in other formations from a vertical bore.

The well bore 10 will normally have a steel casing 11 which may typically have a diameter in the range of 12″–18″. It is also to be understood that while the figures show the drilling of a horizontal hole at right angles to the vertical well bore 10, this system could be modified for drilling at an angle through a particular strata that deviated from the horizontal. The length of the horizontal channel 12 that can be drilled in this fashion is contemplated to extend to a distance of perhaps 1000'. The overall system D also comprises a drill stem or string 14 which includes a plurality of articulated boxes 15 strung together in a continuous chain, a drilling head 16, a high pressure pump 17, a flexible high-pressure fluid conduit 18, and a control console 19.

Figure 2A:
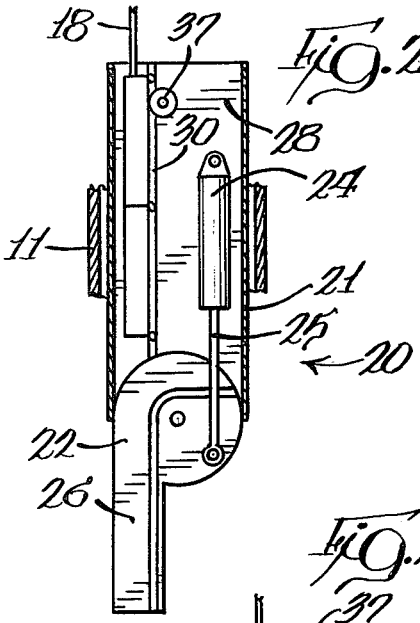
FIGS. 2A and 2B are schematic diagrams showing details of the right angle drive mechanism in two positions.
Figure 2B:
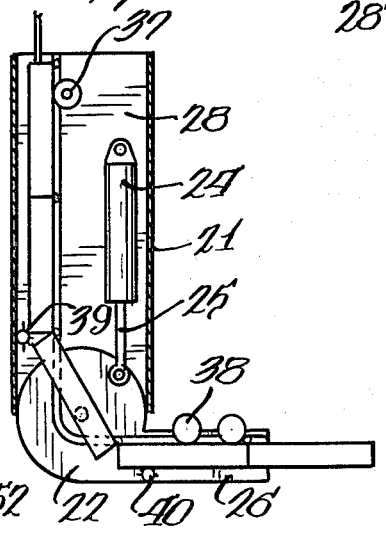

Referring now to FIGS. 2A and 2B, there is illustrated in greated detail the turning mechanism for converting from a vertical to a horizontal drilling direction.

FIG. 2A shows the right angle drive producing portion of the turning mechanism in a vertical position and is designated by the numeral 20. The turning mechanism 20 includes a cylindrical housing portion, a pair of rotatable guide wheels 22 and 23 mounted within the lower end of the housing 21, an hydraulic cylinder 24 having a connecting rod 25 attached to the two guide wheels 22 and 23. A guide extension 26 is mounted on the parallel guide wheels 22 and 23. The guide extension 26 is adapted to turn from the vertical position shown in FIG. 2A to the horizontal position shown in FIG. 2B. A pair of vertical parallel guide plates 28 and 29 are mounted within the housing 21 and are formed on their facing sides with a groove or track 30. The track 30 may be in the form of a recessed groove formed in the guide plates 28 and 29, and guide wheels 22 and 23 or may have an alternative configuration that is effective to direct the linear motion of the drill stem 14 from a vertical direction to the horizontal.

Figure 3A:
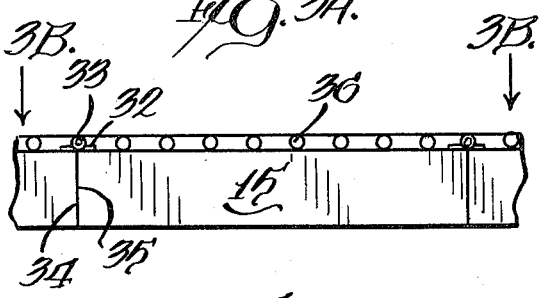
FIG. 3A is a side view of the articulated links or boxes utilized in the drill stem.
Figure 3B:
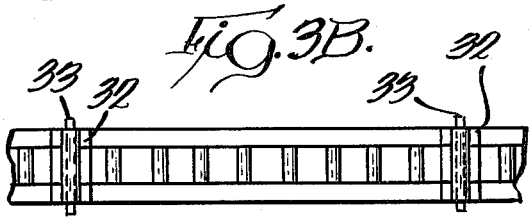
FIG. 3B is a top view taken on lines B—B of FIG. 3A showing chain links mounted on top of the boxes.

Referring to FIGS. 3A and 3B, the plurality of boxes 15 are linked together to form the articulated drill string 14. The individual boxes 15 are generally rectangular in cross section and may have an overall length of from 1'–2'. The boxes are connected together by hinges 32 and pins 33. The pins 33 have an overall length greater than the width of the boxes 15 and the end of the pins 33 are adapted to engage in the groove or track 30. It is important that the overall length of the boxes 15 be uniform and that the ends 34 and 35 of each box abut closely together so as to establish a substantially rigid drill stem 14, except for the degree of motion permitted by the hinges 32. A drive chain 36 is welded on the top of the boxes 15 and forms a continuous chain or driving rack for advancing the drill stem 14. The turning mechanism 20 includes one or more driving sprockets 37 and 38 which engage the chain 36 for advancing or retracting the drill stem 14. The sprockets 37 and 38 are interconnected and driven by a suitable drive mechanism (not shown) that is effective to accommodate for different loads encountered in the advance or retraction of the drill stem 14. A locking and unlocking detent arrangement 39 and 40 for holding the boxes 15 in a linear array, except when turning may also be included in the turning mechanism 20.

Figure 4A:
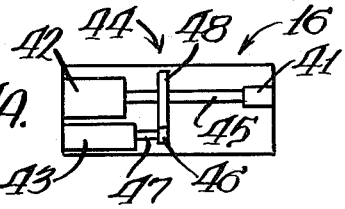
FIGS. 4A, 4B and 4C are alternative designs for drilling heads adapted to be used with the system.
Figure 4B:
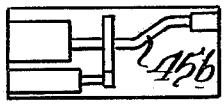
Figure 4C:
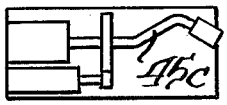

Referring now to FIGS. 4A, 4B and 4C, there are illustrated three alternative designs for the drill head 16. Each design 16 includes a nozzle tip 41, a rotary coupling 42, an hydraulic motor 43, and a driving gear assembly 44. The coupling 42 is connected to the high pressure supply conduit 18 and is also connected to the nozzle 41 by a supply pipe 45. The gear assembly 44 includes a pinion gear 46 mounted on a rotatable drive shaft 47 of the motor 43 and meshing with a driven gear 48 mounted on the pipe 45. The axis of the gear 48 is coincident with the axis of the pipe 45.

FIG. 4B shows substantially the same structure as FIG. 4A except that the supply pipe **45*b*** is offset at an angle by a displacement in the range of 1"–2".

FIG. 4C is an additional modification in which the supply pipe **45*c* is bent at an angle so that the fluid jet ejected from the nozzle 41*c*** tends to form a conical bore in the coal seam as the nozzle advances. The choice of the various drilling head designs and also the nozzle geometry that might be included therein may be selected for the type of geological formation in which it is being used. Alternative nozzle geometry designs have also been shown in our earlier U.S. Pat. No. 4,119,160.

Figure 6:
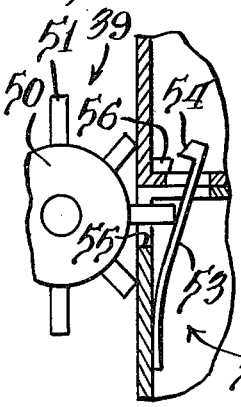
FIG. 6 is an enlarged schematic illustration of a detent arrangement for unlocking the boxes to permit turning.
Figure 5:
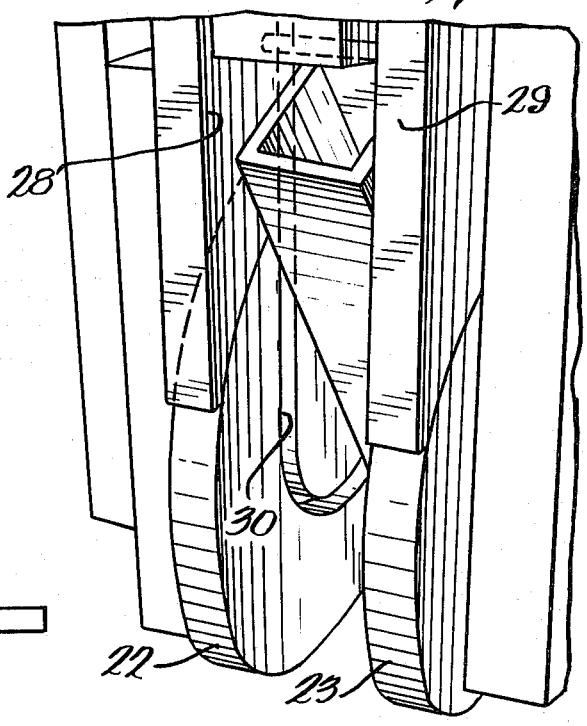
FIG. 5 is an enlarged perspective view of the guiding wheels for directing the boxes into a horizontal plane.

Referring now to FIG. 6, there is illustrated in schematic form a simplified detent arrangement 39. This includes a free running, or driven, cog wheel 50 having a plurality of radial cogs 51 which may be spring loaded. A locking mechanism 52 in the form of a leaf spring 53 carrying a short latching bolt 54 is mounted within each of the boxes 15. The outer wall of each box 15 may be formed with a hole 55 beneath each of the springs 53. In a locked position, the bolt 54 engages a latch 56 on a contiguous box. The wheel 50 is located precisely at the beginning point of the turning arc. To release the mechanism 52, one of the cogs 51 extends into the hole 55 forcing the bolt 54 out of engagement. The boxes 15 separate as permitted by the hinge 32 for turning through the right angle transition. A similar cog wheel is present at 40 for reengaging the locking mechanism 52. The detent arrangements 39 and 40 work in the opposite manner for retracting the drill stem 14. This positive locking detent arrangement assures that the drill stem 14 is maintained in a linear array except when making the right angle transition.

Referring now to FIGS. 7A and 7B, there is described a mathematical analysis of the kinematics involved when the boxes 15 make the right-angle transition. In FIG. 7A there is illustrated a plurality of boxes 15 which for purposes of this description are designated as N, N+1, N+2, and N+3, etc. Each of the boxes 15 has an overall length designated as L. In FIG. 7B the boxes designated as N+1 and N+2 are eliminated for the purpose of simplifying the mathematical description. In FIG. 7A the initial coordinates of the upper edge of box N+2 is designated as $x=o$ and $y=y_i$. The coordinates for box N are: $x=x_i$ and $y=o$. In FIG. 7B box N has moved horizontally by a displacement "d", and the bottom of box N+3 is moved downward through the same displacement "d". In performing this motion, the box N+2 is caused to rotate through an angle $\theta$ about the pin 33. At the same time, the upper edge of the box N+1 is moved to an angular position described as $\Psi$ with respect to the horizontal. In order to described the precise path to be executed by the pins 33 in making the right-angle transition, a mathematical solution for generating this path will be described in terms of the angles $\theta$ and $\Psi$ with respect to the incremental displacements d. The mathematical solution for defining the locus of a particular pin 33 is described in following equations:

$$A + B\cos\psi + C\sin\psi = 0 \qquad (1)$$

$$\text{Where } A = 2 + \sqrt{2} - 2\frac{d}{L} + 2\frac{d^2}{L^2}$$

$$B = -\left(\sqrt{2} + 2\frac{d}{L}\right)$$

$$C = -\left(2 + \sqrt{2}\right) + 2\frac{d}{L}$$

Which Has A Solution $$\text{Sin } \psi = \frac{-AC + B\sqrt{B^2 + C^2 - A^2}}{C^2 + B^2} \quad (2)$$

$$\text{Sin } \theta = \frac{\sqrt{2}}{2} + \frac{d}{L} - \cos \psi \quad (3)$$

It should be noted for a particular incremental displacement these equations give two possible solutions. As shown in FIG. 7B, the points defined for these two solutions are designated as F and F'. In this embodiment, the point F' is of no interest and can be eliminated from further analysis. The kinematic synthesis of the desired curve can proceed by taking the incremental displacements as small as may be desired to generate the required curve.

Referring to FIG. 8, there is illustrated the generation of such a curve through approximately 12 incremental steps. In actual practice these increments could be made as small as required; but the final solution for describing the desired curve is given in equations (2) and (3) above.

Having once established these equations, it is possible to calculate the path to be followed by either a guiding pin in a groove 30 or by a track for the outer edges of the individual boxes as they are guided through the right-angle transition. The solution of the curve generated thus insures that for any incremental displacement downward of the individual boxes, there is exactly a corresponding equal horizontal displacement of the boxes that have made the right-angle transition into the horizontal plane. A corresponding statement can be made for the retraction of the drill string 14. This insures that the speed in and the speed out of the boxes through the right-angle transition are equal at all times. This would not be true for any curve other than the one described herein. In other words this is a unique solution for this particular problem.

In the absence of provision for the path 30 carefully defined, it is possible for the individual boxes to bind within the turning mechanism. Providing a path according to the above equations insures that the individual boxes 15 make the right-angle smoothly and without interference.

While the invention has been described as operating in a vertical plane, the apparatus could be modified so as to operate equally well in a horizontal plane, i.e., for drilling holes at right angles from an initial horizontal position.

It is to be understood that the embodiment shown and described is the preferred one and that many changes and modifications may be made thereto without departing from the spirit of the invention. The invention is not to be considered as limited to this embodiment except insofar as the claims may be limited.

We claim:

1. Drilling apparatus including a source of fluid under high pressure connected to a flexible conduit, and a rotatable fluid jet nozzle connected to the conduit for drilling horizontal holes in geological strata from a vertical bore comprising:

a vertical drill stem carrying said conduit and having a chain of innerconnected, articulated links;

a nozzle drilling head attached to a lower end of said vertical drill stem and connected hydraulically to said conduit;

direction changing means attached at the lower end of said drill stem for directing said chain of links through a right angle turn from a vertical orientation to a substantially horizontal direction;

actuating means mounted on said direction changing means for directing the orientation of said nozzle drilling head at some desired depth; and drive means attached to said direction changing means and operable for advancing and retracting said nozzle drilling head.

2. The drilling apparatus of claim 1 including:

positive locking detent means for interlocking said individual links for thereby maintaining said links in a linear array.

3. The drilling apparatus of claim 2 including:

release means attached to said direction changing means and interacting with said detent means whereby said links are unlocked for making the right angle transition.

4. The drilling apparatus of claim 1 wherein:

said links are generally in the shape of elongated hollow rectangular boxes; and said flexible fluid conduit extends longitudinally through and is surrounded by said boxes.

5. The drilling apparatus of claim 1 wherein:

said direction changing means includes structural guide means for providing a constant velocity drive of said individual links through the right angle transition.

6. The drilling apparatus of claim 4 wherein:

said structural means includes a guide path defined according to an unique mathematical formula.

7. The drilling apparatus of claim 5 wherein: said mathmetical formula is:

$$A + B \cos \psi + \sin \psi = 0 \quad (1)$$

$$\text{Where } A = 2 + \sqrt{2} - 2\frac{d}{L} + 2\frac{d^2}{L^2}$$

$$B = -\left(\sqrt{2} + 2\frac{d}{L}\right)$$

$$C = -\left(2 + \sqrt{2}\right) + 2\frac{d}{L}$$

Which has a solution:

$$\text{Sin } \psi = \frac{-AC + B\sqrt{B^2 + C^2 - A^2}}{C^2 + B^2} \quad (2)$$

$$\text{Sin } \theta = \frac{\sqrt{2}}{2} + \frac{d}{L} - \cos \psi \quad (3)$$

* * * * *